US007284951B2

(12) United States Patent
Diehl et al.

(10) Patent No.: US 7,284,951 B2
(45) Date of Patent: Oct. 23, 2007

(54) METHOD FOR CONVEYING A LIQUID F CONTAINING AT LEAST ONE (METH)ACRYLIC MONOMER

(75) Inventors: Volker Diehl, Ellerstadt (DE); Dimitrios Markopoulos, Mutterstadt (DE); Juergen Schroeder, Ludwigshafen (DE); Michael Blechschmitt, Schifferstadt (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 498 days.

(21) Appl. No.: 10/516,498

(22) PCT Filed: Jun. 20, 2003

(86) PCT No.: PCT/EP03/06516

§ 371 (c)(1),
(2), (4) Date: Dec. 2, 2004

(87) PCT Pub. No.: WO2004/003389

PCT Pub. Date: Jan. 8, 2004

(65) Prior Publication Data

US 2005/0232782 A1 Oct. 20, 2005

(30) Foreign Application Priority Data

Jun. 27, 2002 (DE) ..... 102 28 859

(51) Int. Cl.
*F04D 29/12* (2006.01)

(52) U.S. Cl. ..... 415/113; 415/231

(58) Field of Classification Search ..... 415/113, 415/231

See application file for complete search history.

(56) References Cited

U.S. PATENT DOCUMENTS

| | | | |
|---|---|---|---|
| 4,168,936 | A | 9/1979 | Scheller et al. |
| 4,865,333 | A | 9/1989 | Winslow |
| 5,727,792 | A | 3/1998 | Rockwood |

FOREIGN PATENT DOCUMENTS

| | | | |
|---|---|---|---|
| DE | 102 24 341 | | 7/2003 |
| EP | 1 092 874 | | 4/2001 |
| JP | 10159987 A | * | 6/1998 |

* cited by examiner

*Primary Examiner*—Richard Edgar
(74) *Attorney, Agent, or Firm*—Oblon, Spivak, McClelland, Maier & Neustadt, P.C.

(57) ABSTRACT

A method of delivering a fluid containing at least one (meth)acrylic monomer by a pump in which a pump cavity and drive compartment are separated by a separator compartment filled with a baffler medium at elevated pressure and that is sealed with double-acting slide ring packings.

10 Claims, 12 Drawing Sheets

METHOD FOR CONVEYING A LIQUID F CONTAINING AT LEAST ONE (METH)ACRYLIC MONOMER

The present invention relates to a method of delivering a fluid F which contains at least one (meth)acrylic monomer by means of a delivery pump comprising a) a pump cavity, b) a drive compartment and c) a separator compartment which separates the pump cavity and the drive compartment and where the pump cavity contains at least one delivery element for delivering the fluid F;

the fluid F is fed to the pump cavity with an input energy;

the fluid F leaves the pump cavity with an output energy which exceeds the input energy;

a shaft driven in the drive compartment is run out from the drive compartment through the separator compartment into the pump cavity;

the at least one delivery element contained in the pump cavity is linked in such a way to the driveshaft run into the pump cavity that the driveshaft can transmit a torque to the delivery element;

the separator compartment is filled with a barrier medium which comprises a barrier gas and/or a barrier liquid and differs from the fluid F; and the driveshaft is not supported within the pump cavity.

The notation (meth)acrylic monomers in the present publication represents a shortened version of "acrylic monomers and/or methacrylic monomers".

The term acrylic monomer in the present publication is a shorter way of referring to acrylic acid, esters of acrylic acid and/or acrylonitrile.

The term methacrylic monomer in the present publication is a shorter way of referring to methacrylic acid, esters of methacrylic acid and/or methacrylonitrile.

In particular, the (meth)acrylic monomers referred to in the present publication are intended to comprise the following (meth)acrylic acid esters: hydroxyethyl acrylate, hydroxyethyl methacrylate, hydroxypropyl acrylate, hydroxypropyl methacrylate, glycidyl acrylate, glycidyl methacrylate, methyl acrylate, methyl methacrylate, n-butyl acrylate, n-butyl methacrylate, tert-butyl acrylate, tert-butyl methacrylate, ethyl acrylate, ethyl methacrylate, 2-ethylhexyl acrylate, 2-ethylhexyl methacrylate, N,N-dimethylaminoethyl acrylate and N, N-dimethylaminoethyl methacrylate.

(Meth)acrylic monomers are important starting materials for the preparation of polymers which are used, for example, as adhesives.

(Meth)acrylic acid on an industrial scale is predominantly produced by catalytic gas phase oxidation of suitable $C_3/C_4$ precursor compounds, especially of propene and propane in the case of acrylic acid, and of isobutene and isobutane in the case of methacrylic acid. In addition to propene, propane, isobutene and isobutane, however, suitable precursors include other compounds containing 3 or 4 carbon atoms, for example isobutanol, n-propanol, or the methyl ether of isobutanol.

This normally affords a product gas mixture from which the (meth)acrylic acid must be separated by procedures involving absorption, rectification, extraction and/or crystallization (compare e.g. DE-A 10224341). Correspondingly, (meth)acrylonitrile can be obtained by catalytic ammoxidation of the abovementioned $C_3/C_4$ precursor compounds and subsequent separation from the product gas mixture.

Esters of (meth)acrylic acid can be obtained, for example, by a direct reaction of (meth)acrylic acid with the corresponding alcohols. Even in this case, however, this initially gives rise to product mixtures from which the (meth)acrylic esters must be separated e.g. by rectification and/or extraction.

Particularly in connection with the abovementioned separations it is necessary again and again to deliver (meth) acrylic monomers present in more or less pure form or in solution (generally referred to in the present publication as fluids containing (meth)acrylic monomers F).

In this context, the solvent can be either aqueous or an organic solvent. The specific type of the solvent is essentially unimportant according to the invention. The (meth) acrylic monomer content of solutions to be delivered can be ≧5 wt %, or ≧10 wt %, or ≧20 wt %, or ≧40 wt %, or ≧60 wt %, or ≧80 wt %, or ≧90 wt %, or ≧95 wt %, or ≧99 wt %.

In the context of said delivery, differences in height and/or flow resistances must be overcome. This is only possible by energy being supplied to the fluid to be delivered. This is usually effected by means of apparatuses, so-called flow machines, which are also referred to as pumps.

Ullmanns Encyklopädie der technischen Chemie, 4th edition, volume 3, pp. 155 to 184, Verlag Chemie 1973, describes a multiplicity of pumps which can be used to deliver fluids. Not every pump, however, is suitable for the delivery of fluids F containing (meth)acrylic monomers (e.g. such (meth)acrylic monomers present in more or less pure form or in solution). This is because (meth)acrylic monomers, on the one hand, are not entirely safe from a toxicological point of view and, on the other hand, can readily be caused, by heating, to undergo free-radical polymerization.

The pump to be used should therefore be of such design that apart from the inlets and outlets for the fluid F to be delivered which contains at least one (meth)acrylic monomer it does not have any unintentional exit locations, leaks. At the same time, however, it should be of such design that no components subject to extreme mechanical loads (e.g. bearings of driveshafts) will come into contact with the fluid F. This is because heat is generated at such components subject to mechanical loads, said heat possibly giving rise to undesirable free-radical polymerization of the (meth)acrylic monomers.

EP-A 1092874 therefore recommends, in its FIG. 3, that for the delivery of a fluid F containing at least one (meth) acrylic monomer a delivery pump be used which is a delivery pump as described at the outset of the present application. The barrier medium here is a gas at atmospheric pressure, and to seal the separator compartment from the drive compartment it is recommended that a mechanical seal be used. The question of sealing the separator compartment from the pump cavity is left open by EP-A 1092874.

A drawback of the delivery pump recommended in FIG. 3 of EP-A 1092874, however, is that the pump cavity is necessarily located underneath the drive compartment and the driveshaft must be arranged vertically.

It is an object of the present invention to overcome these drawbacks when using a delivery pump according to the abovementioned prior art.

Accordingly, a method was found of delivering a fluid F which contains at least one (meth)acrylic monomer by means of a delivery pump comprising a) a pump cavity (3),
b) a drive compartment (5) and
c) a separator compartment (4) which separates the pump cavity and the drive compartment and where the pump cavity contains at least one delivery element (7) for delivering the fluid F;

the fluid F is fed to the pump cavity with an input energy;

the fluid F leaves the pump cavity with an output energy which exceeds the input energy;

a shaft (9) driven (10) in the drive compartment is run out from the drive compartment through the separator compartment into the pump cavity;

the at least one delivery element contained in the pump cavity is linked in such a way to the driveshaft run into the pump cavity that the driveshaft can transmit a torque to the delivery element;

the separator compartment is filled with a barrier medium which comprises a barrier gas and/or a barrier liquid and differs from the fluid F; and the driveshaft is not supported (8) within the pump cavity wherein the pressure of the barrier medium exceeds the pressure in the pump cavity and the pressure in the drive compartment, and that section of the driveshaft which runs through the separator compartment is fitted, both toward the pump cavity and toward the drive compartment, with sliding elements (6) which are permanently and impermeably attached to the driveshaft and sealingly slide on the separator compartment inner walls through which the driveshaft passes (principle of double-acting (acting on both sides) sliding elements (e.g. ring seal)).

Figure 8A:
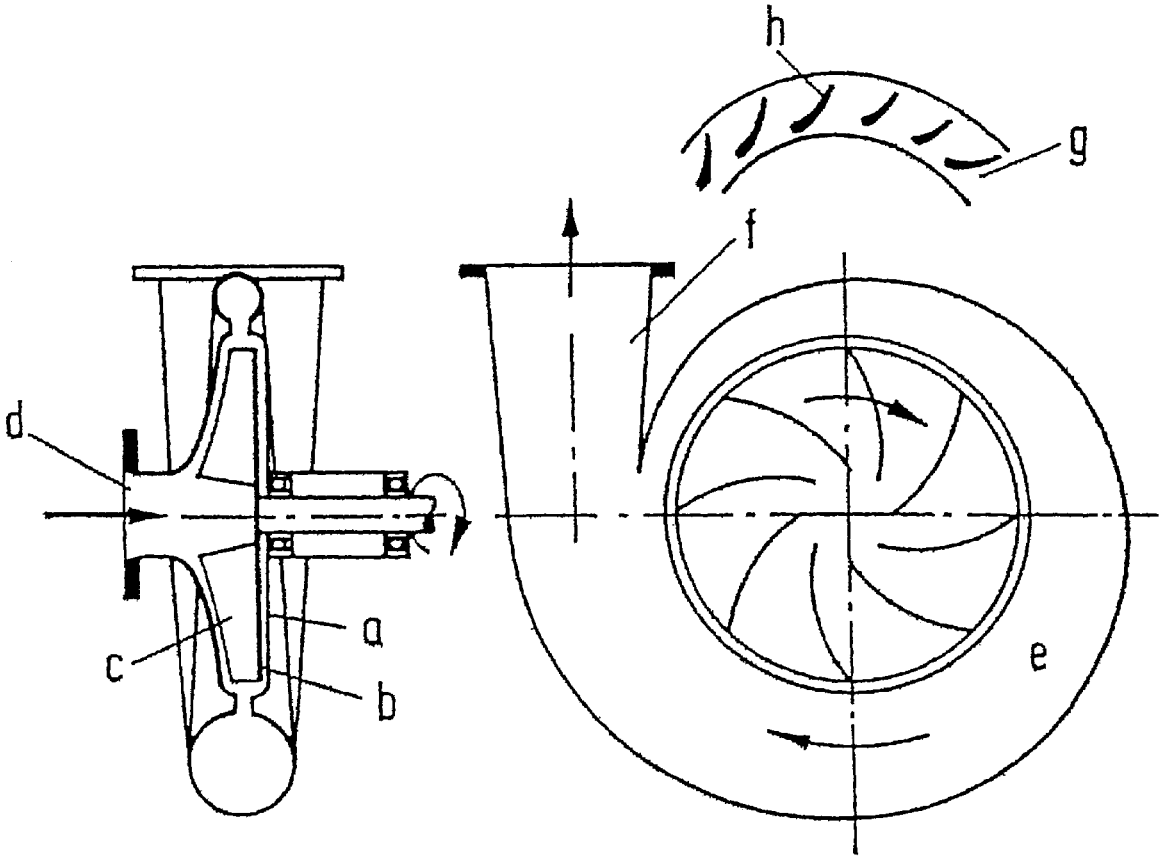
Figure 8B:
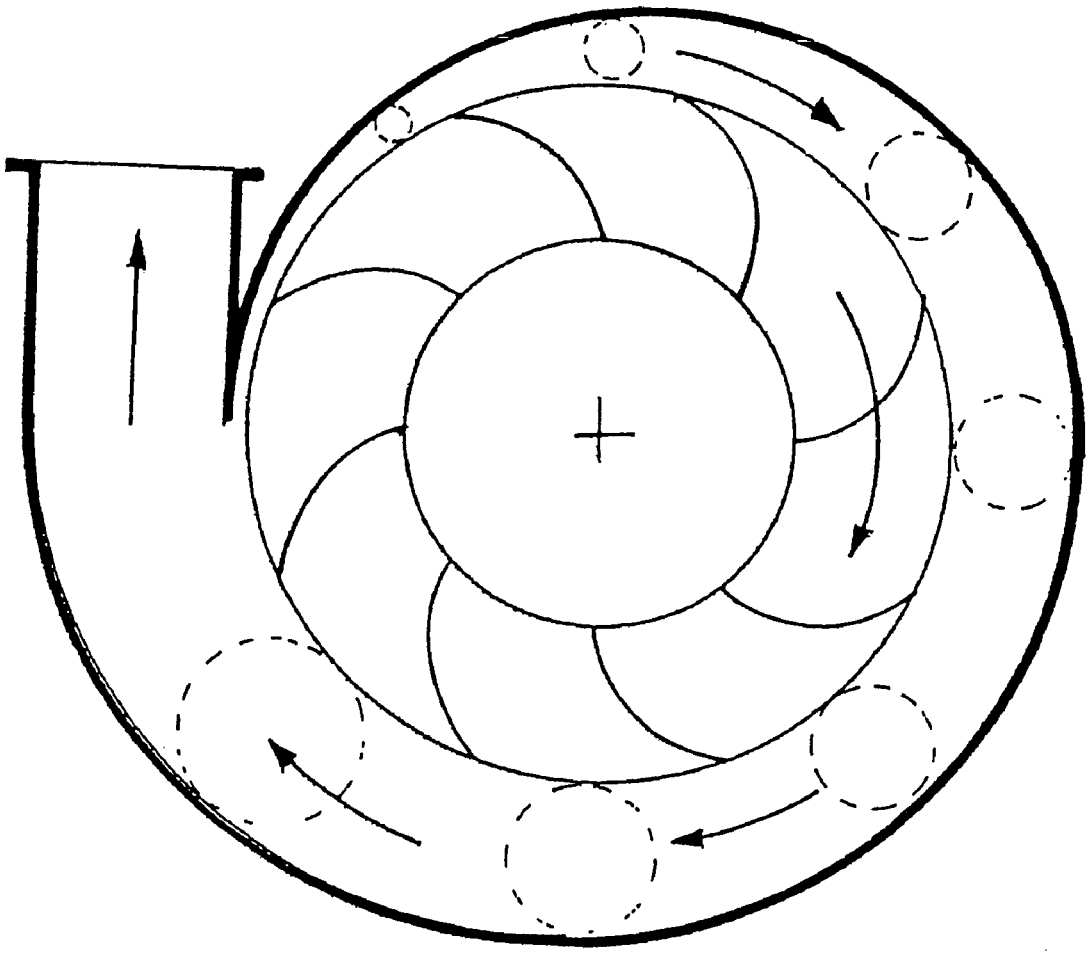
Figure 9:
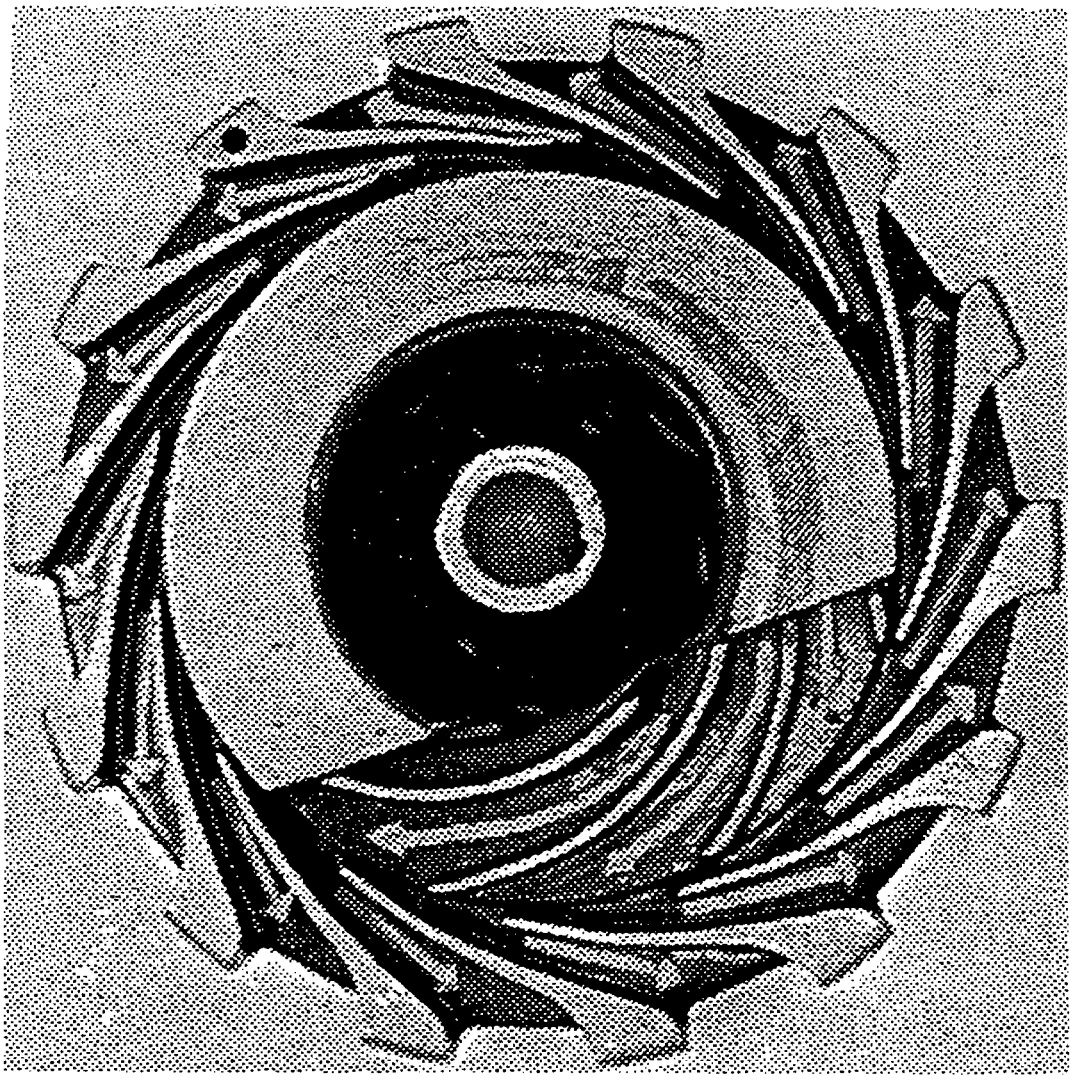
Figure 10:
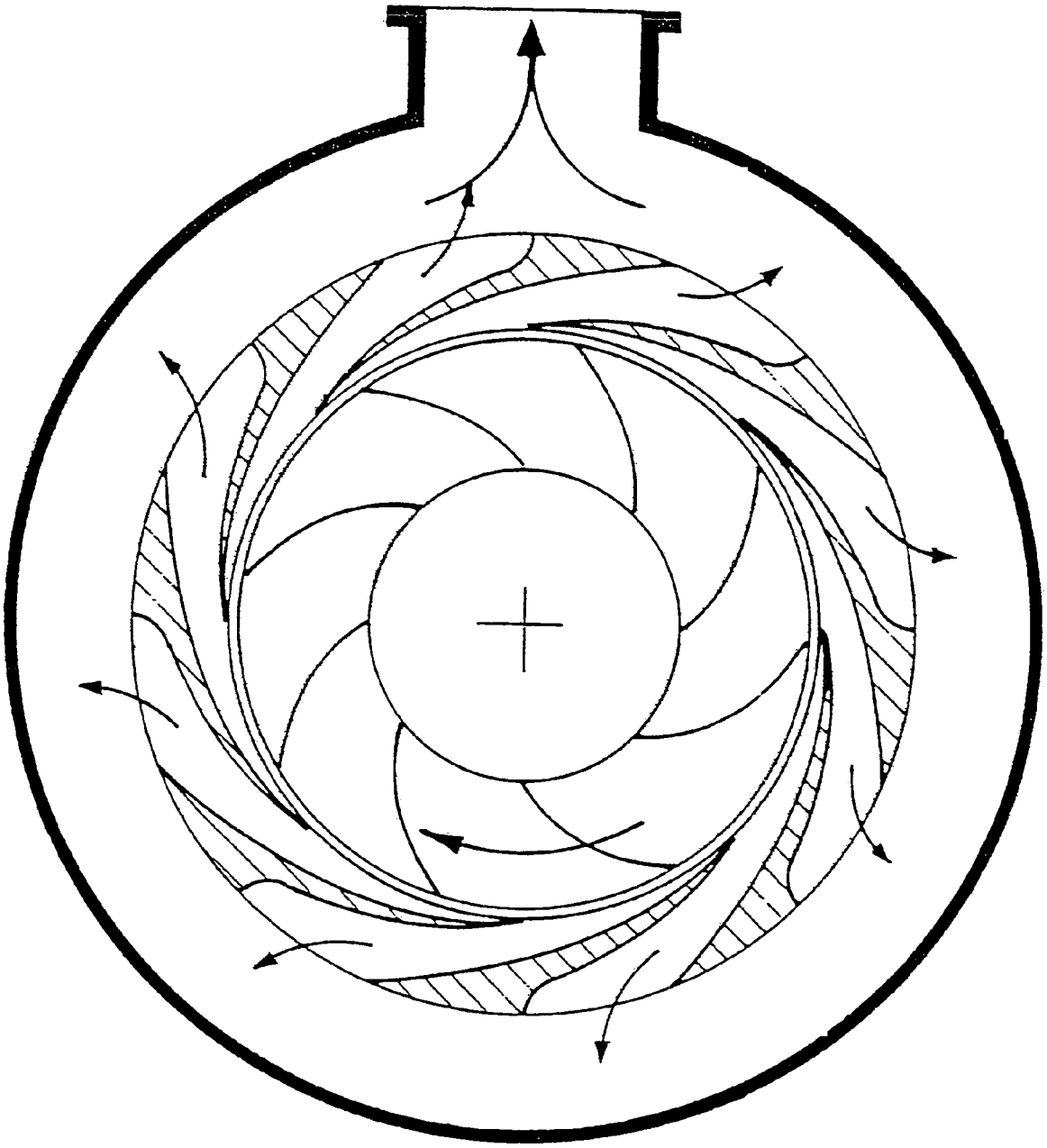

FIGS. 8*a* and 8*b* show the mode of operation of the centrifugal pump;

FIG. 9 shows an impeller with fixed stators;

FIG. 10 shows an impeller with fixed stators; and

Figure 11:
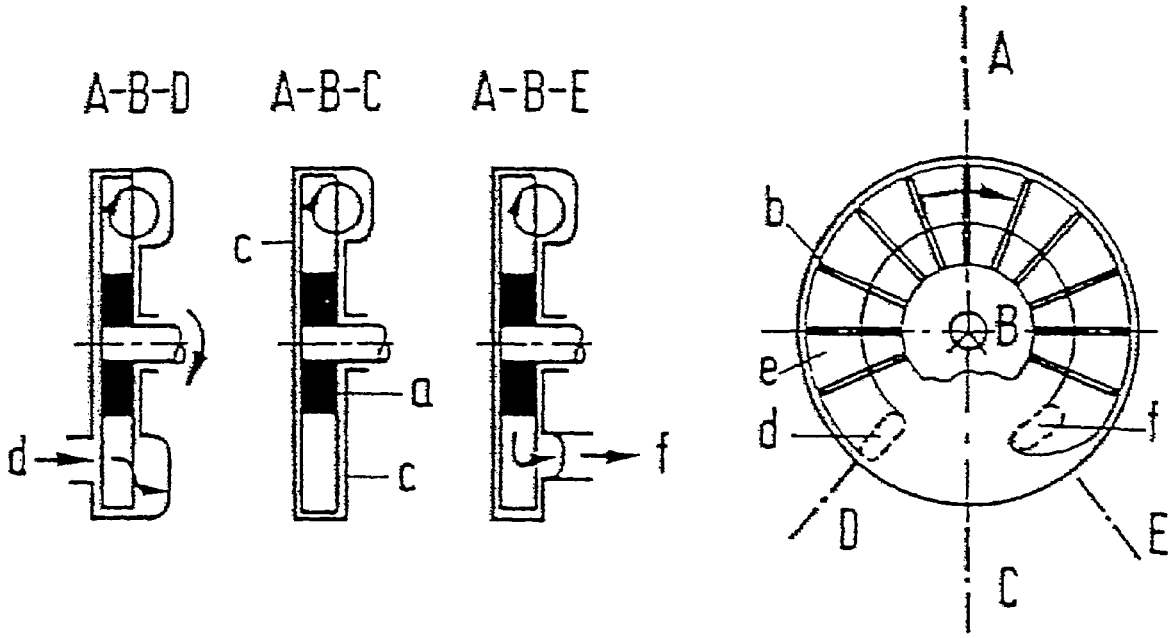

FIG. 11 shows a side channel pump impeller.

Figure 1:
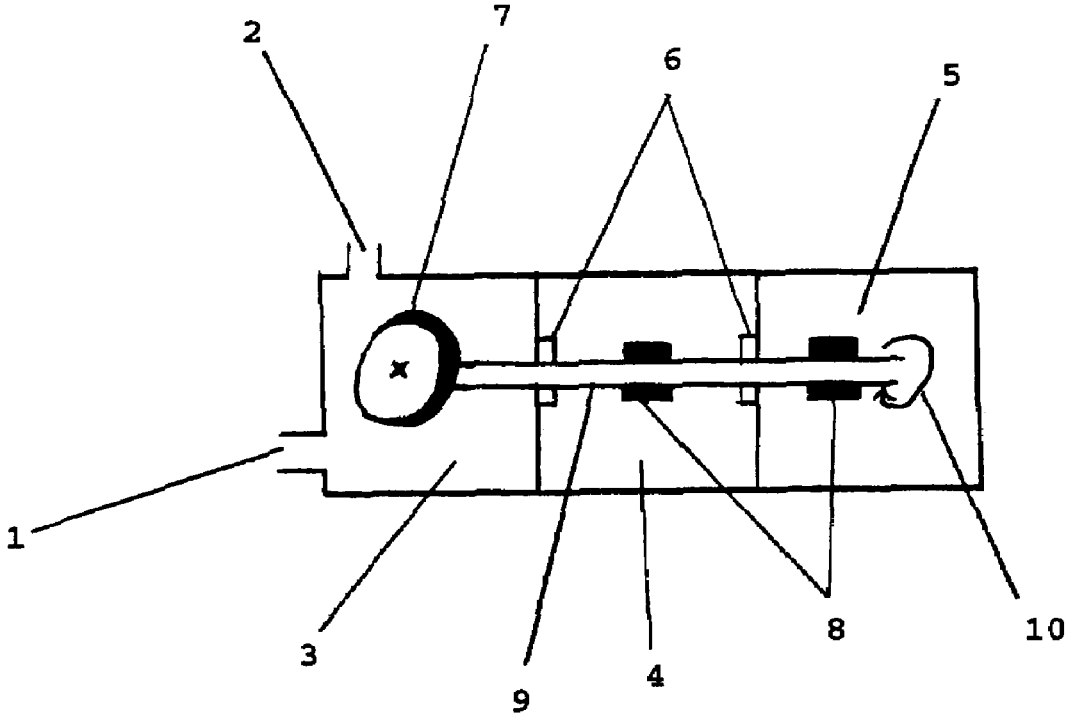
FIG. 1 shows a schematic depiction of a delivery pump to be used according to the invention.

The numerical addresses put in parentheses refer to FIG. 1 of the present publication, which shows a schematic depiction of a delivery pump to be used according to the invention. The addresses (1) and (2) indicate the inlet and outlet site, respectively, of fluid F into and out of, respectively, the delivery pump.

Preferably, according to the invention, the pressure in the separator compartment exceeds the pressure at that location in the pump cavity which is situated opposite to the sliding element by at least 1 bar. This pressure differential is often ≧2 bar, or ≧3 bar. As a rule, this pressure differential will be ≦10 bar.

If the barrier medium used in the method according to the invention is a gas, it is preferably an oxygen-containing gas, as molecular oxygen has a polymerization-inhibiting effect on (meth)acrylic monomers. Said polymerization-inhibiting effect manifests itself especially in conjunction with the polymerization inhibitors customarily present in fluid F, e.g. phenothiazine or methoxyphenol. Equally, of course, the fluid F in the method according to the invention can contain any other known polymerization inhibitor.

Preferably, the oxygen content of such a barrier gas is from 4 to 21 vol %. If fluids F to be delivered have a flashpoint (determined according to DIN EN 57)≦50° C., an oxygen content of a barrier gas of from 4 to 10 vol % is most especially preferred.

If a barrier liquid (e.g. 2-ethylhexanol) is used in the method according to the invention, said barrier liquid is preferably chosen so as to be compatible with the fluid F to be delivered and the (meth)acrylic monomers present therein. Barrier liquids preferred according to the invention are mixtures of ethylene glycol and water or said two liquids by themselves. Particularly preferred in this context are those mixtures whose ethylene glycol content is from 30 to 40 wt %. Said ethylene glycol/water mixtures exhibit excellent viscosity behavior and, moreover, prove comparably freeze-resistant under standard external conditions. According to the invention, barrier liquids are preferred to barrier gases.

Pumps to be used preferentially according to the invention are centrifugal pumps and side channel pumps. As a rule, they comprise slide ring packings as the sliding elements having a sealing effect. Said slide ring packings comprise a slide ring permanently attached to the driveshaft and rotating therewith, and a counter ring fixed within the separator compartment inner wall.

Figure 2:
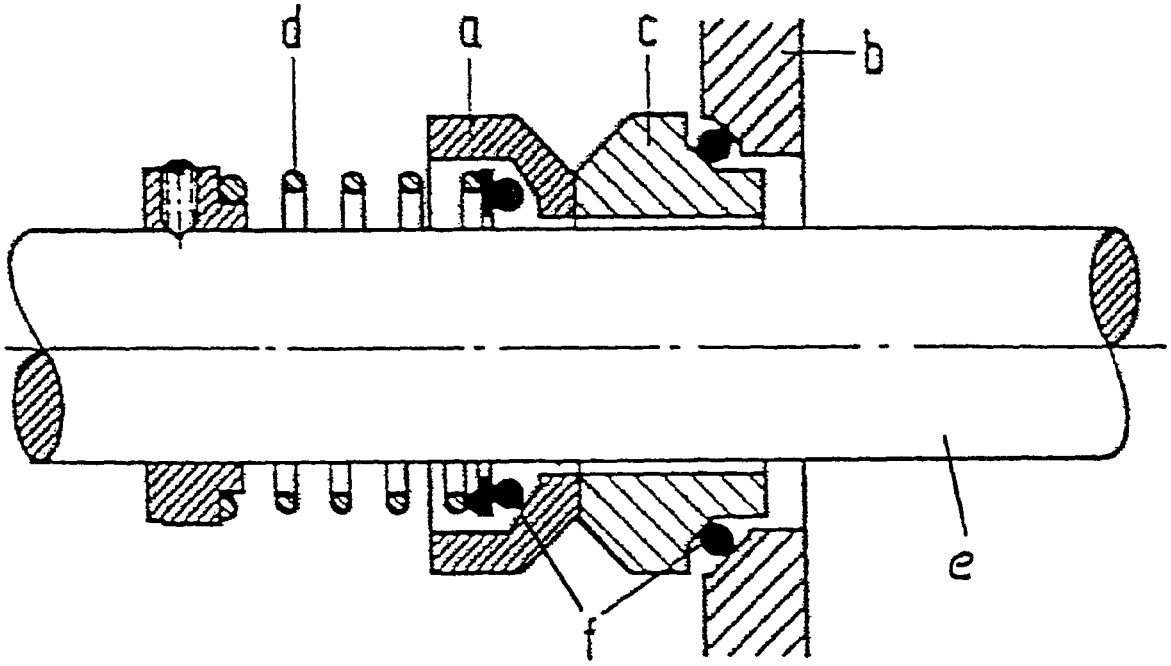
FIG. 2 shows the principle of a slide ring packing.

A spring normally forces the slide ring against the counter ring with a preload of from 1 to 2 bar. In operation, said preload is supplemented by the elevated pressure of the barrier medium present between the slide ring packings. Owing to the elevated pressure of the barrier medium, compared with the pressure prevailing on the discharge side of the pump, the fluid F to be delivered is prevented from escaping from the pump cavity. FIG. 2 shows the principle of a slide ring packing, the symbols having the following meanings: a=rotary slide ring; b=casing wall; c=counter ring; d=spring; e=shaft; f=toroidal sealing rings (either these or bellows can form a seal against the shaft and the casing wall b).

As a result of the elevated pressure in the barrier medium, a small amount of barrier medium normally will continuously enter the fluid F being delivered. In the case of a barrier liquid, said leakage rate can be from 0.2 to 5 ml/h, with a delivery rate of from 1 $m^3$/h to 4000 $m^3$/h. For barrier gases, the leakage rate, based on the same delivery rate, is from 120 to 150 Nml/h of barrier gas. According to the invention, the leakage rate is expediently made good continuously from reservoirs.

The barrier medium, e.g. the barrier liquid, may thus also contribute to lubrication of the sliding surfaces. More detailed information on the calculation and design of axial sliding ring packings can be found in E. Mayer: "Berechnung and Konstruktion von axialen Gleitringdichtungen" [Calculation and design of axial sliding ring packings], Konstruktion 20, 213-219 (1968).

Generally, the (meth)acrylic monomer content of the barrier medium in wt % is less than that of the fluid F.

In contrast to reciprocating pumps and rotary-piston pumps, which operate according to the displacement principle, centrifugal pumps and side channel pumps operate according to the dynamic principle. A rotating rotor (the delivery element linked to the driveshaft) causes work in the form of kinetic energy to be transferred from the rotor to the fluid F to be delivered. Downstream of the rotor, in a stator and/or in the volute, the kinetic energy is predominantly reconverted into static pressure (pressure energy, energy conservation law). In principle, the rotor is a simple disk fitted with vanes (as shown by way of example in FIG. 3).

Figure 3:
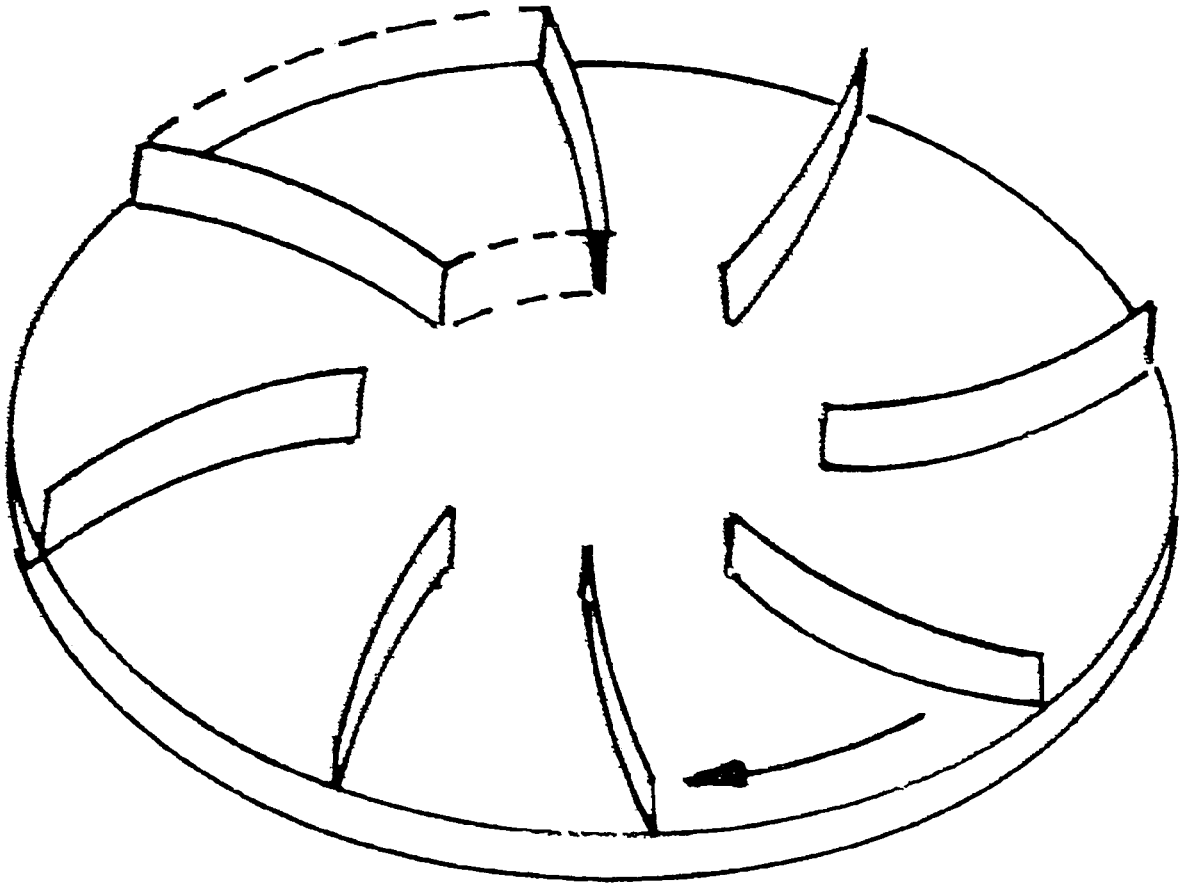
FIG. 3 shows an open rotor.

The vanes form rotor passages whose cross section normally increases very markedly from the interior outward, owing to the increasing circumference (see dashed lines in FIG. 3). Via these rotor passages, as much fluid F can be flung away as is able to flow in at the center of the rotor. In contrast to the piston pump, the fluid F to be delivered therefore flows permanently during operation of a centrifugal and side channel pump.

Figure 4:
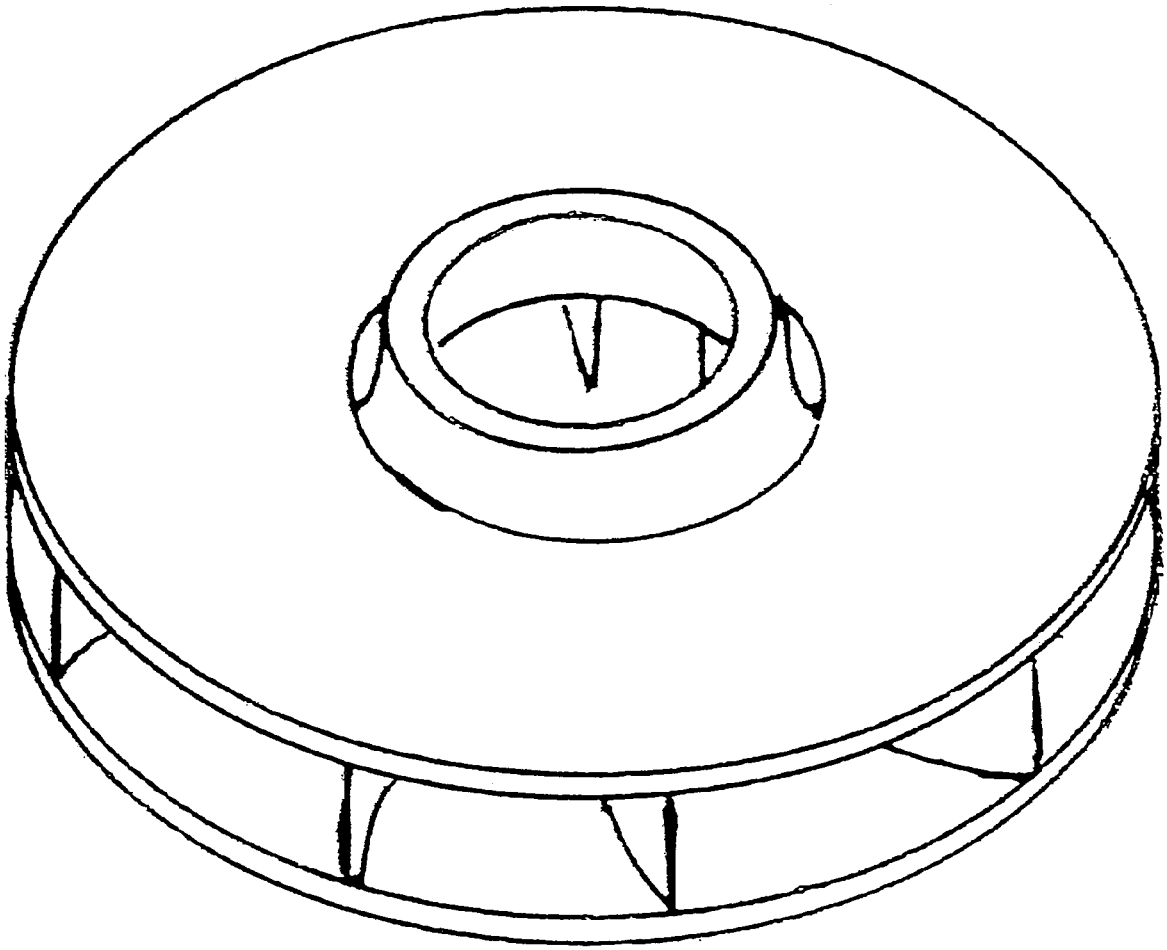
FIG. 4 shows a closed rotor.

As opposed to the open rotor shown in FIG. 3 it is also possible to employ closed rotors (FIG. 4). Here the rotor passages are simply covered by a second disk which has a hole in its center.

Figure 5:
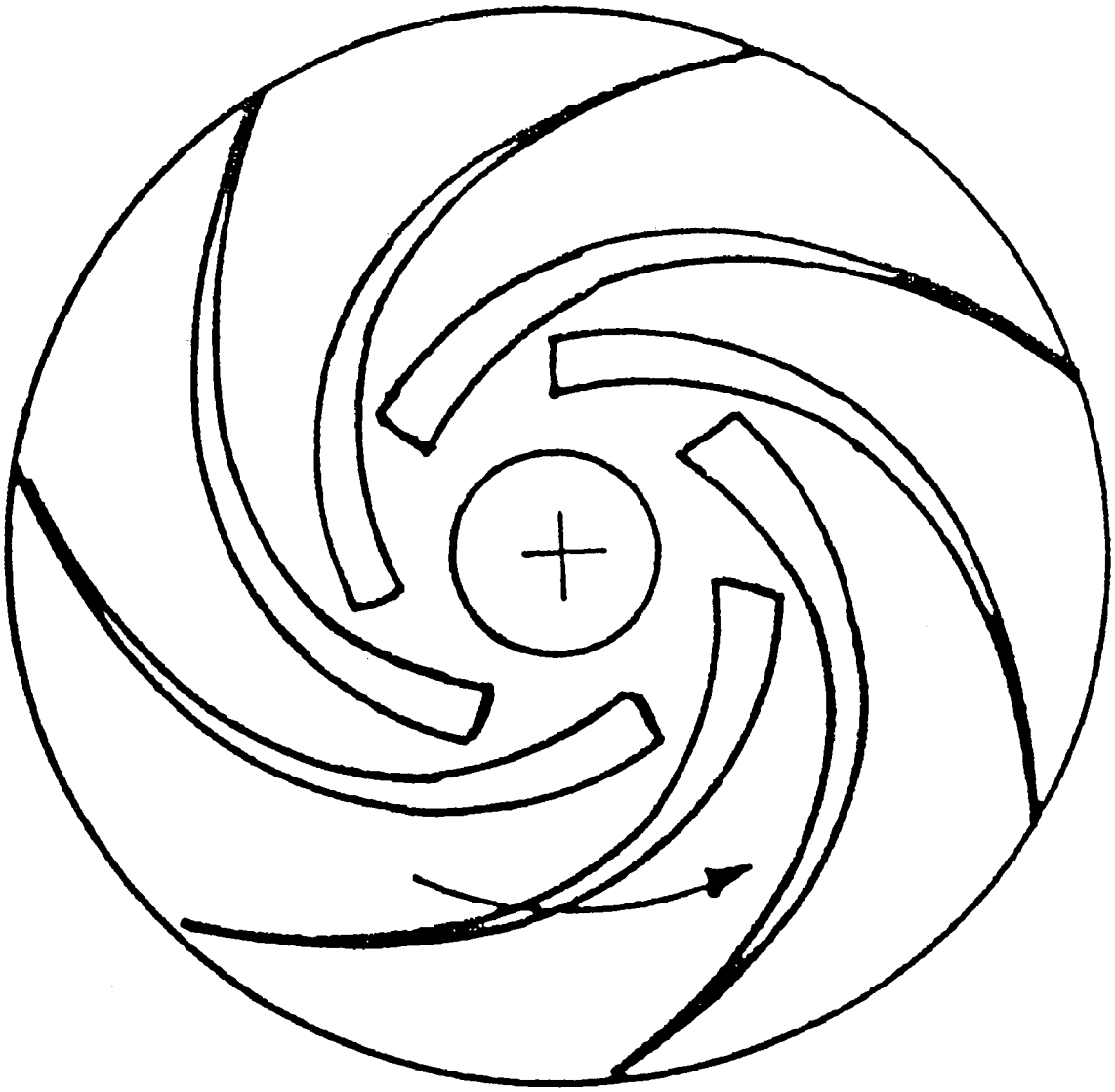
FIG. 5 shows a plan view from above an impeller.
Figure 6:
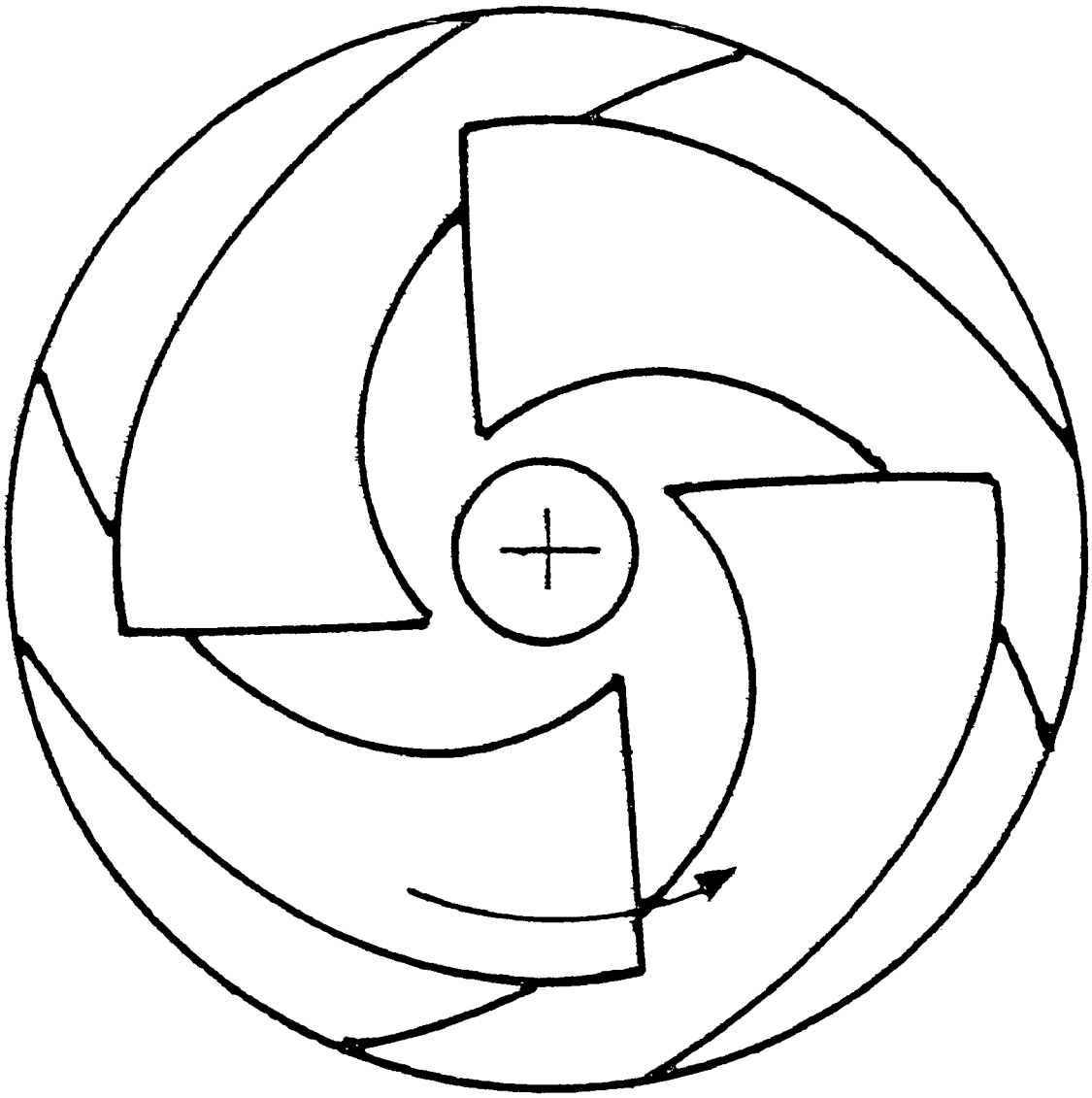
FIG. 6 shows a plan view from above for an alternate impeller.
Figure 7:
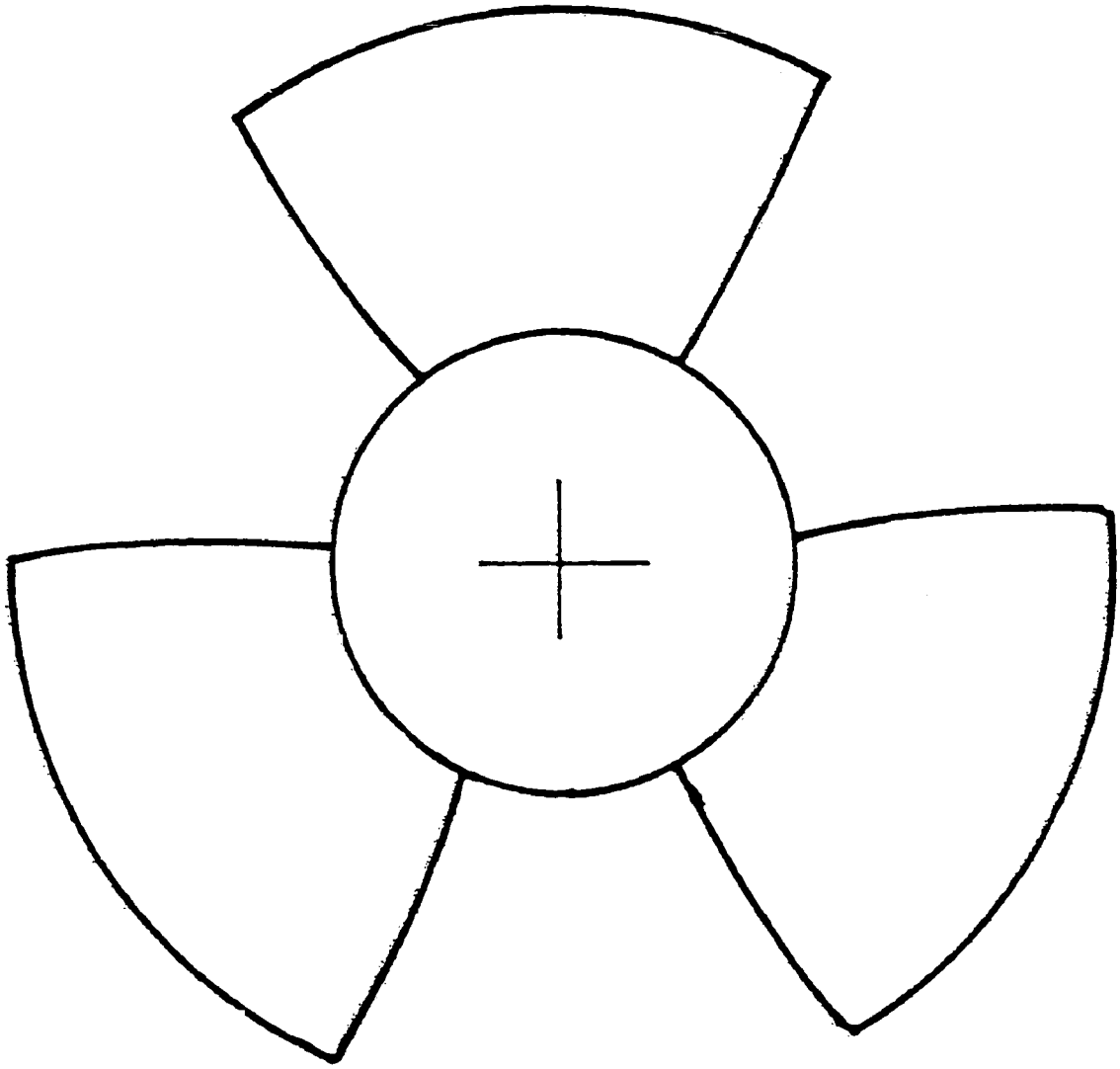
FIG. 7 shows a plan view from above for yet another impeller.

The plan view from above of an impeller is shown in FIG. 5. The curvature of the vanes as a rule coincides with the natural trajectory of a drop of water on a rotating, round, smooth disk as seen by a co-rotating observer if the drop of water is allowed to fall onto the center of the disk. This vane shape is referred to as "backward-curved" vane. In principle, however, it is also possible to use vanes having up to a slight forward curvature, as well as propeller-shaped vanes, i.e. internally twisted, backward-curved vanes whose edges project as far as the rotor inlet and which grab the fluid F like a ship's propeller (compare FIGS. 6 and 7, plan view from above).

The mode of operation of a centrifugal pump (a centrifugal-pump cavity) is illustrated in an exemplary manner by FIG. 8*a, b*. It consists of the pump casing (a) and the rotor (b) rotating therein, which is equipped with vanes (c). The fluid F enters axially through the intake port (d). As a result of centrifugal force it is directed radially outward and on this path it is accelerated to a high velocity by the rotor. One of the functions of the pump casing is to intercept the fluid F from all the rotor passages to allow the collected fluid to be passed onward through the discharge ports (F). Another function of the pump casing, however, is to convert kinetic energy of the fluid F into pressure. To this end use is made, as a rule, of the fact that an increase in cross section reduces the velocity of the fluid F, thereby causing a pressure increase. To increase the cross section, two pump casing designs are customary. In single-stage pumps, or downstream of the last stage of multistage centrifugal pumps, volutes are often used. Such a volute spirally (e) encloses the rotor. The cross section increases toward the discharge port (see increasing circle radii in FIG. 8*b*). The fluid F flowing through is thereby decelerated, which means that the pressure increases at the same time.

As an alternative to the spiral, particularly in the case of multistage pumps, fixed stators (g) can be used. The stator is incorporated in the pump casing and has the shape of an annular chamber. It encloses the rotor. Arranged in the stator are guide vanes (h) which, with respect to one another, form channels that widen continuously in an outward direction (FIGS. 9 and 10). In this design, the fluid F is not flung directly into the pump casing, initially flowing through the stator passages instead. Owing to these widening in the flow direction, they again cause a reduction in flow velocity and a consequential pressure buildup. The direction of the stator passages is normally counter to the direction of the rotor passages and, at the inner circumference of the stator, corresponds to the direction of the exit velocity of the delivery fluid from the rotor. Another function of the stator, in the case of two-stage centrifugal pumps, is to collect the fluid F and duct it to the inlet of the second stage.

Of course it is also possible to employ a combination of stator and volute. This means that the fluid F is first collected in the stator before being able to pass into the volute.

Depending on the shape of the rotors and thus on the exit direction of the fluid F, a distinction is made between radial, semiaxial (also diagonal or screw rotor) and axial pumps (propeller pumps).

Whereas so far, in essence, only the pump cavity has been described, the following discussion is intended to address the drive compartment as well. High-speed motors such as electric motors, internal-combustion engines or steam turbines drive the rotor in direct coupling. The coupling is effected by a driveshaft. The support for the latter can be accommodated solely in the drive compartment, as shown by FIG. 3 of EP-A 1092874. If necessary, however, it can in addition also be supported in the separator compartment. It is advantageous, according to the invention, that for centrifugal and side channel pumps a simple support arrangement of the driveshaft is sufficient. This is due to the low weight of the rotor.

Alternatively, however, the pump cavity of the method according to the invention can be designed as a multistage centrifugal pump, as described in Pumpen in der Feuerwehr, Teil I, Einführung in die Hydromechanik, Wirkungsweise der Kreiselpumpen [Fire brigade pumps, Part I, Introduction into hydrodynamics, mode of action of centrifugal pumps], 4th edition 1998, Verlag W. Kohlhammer, Berlin. Single-stage centrifugal pumps are preferred according to the invention.

In the case of a side channel pump cavity (compare FIG. 11), a narrow rotor (a) having open vanes (b) rotates in the casing (c) in which a side channel next to the vanes runs round the major part of the circumference. The fluid to be delivered enters the vane chambers not in the axis but through a slot (d) from the frontal face, the fluid already present in the chambers being simultaneously driven outward by centrifugal force. At the discharge edges of the vanes the flow is deflected off the casing wall into the side channel where it describes a helical trajectory and, having covered a certain distance, reenters the rotor. This phenomenon is repeated for a fluid particle en route from the intake port to the discharge port e.g. from 10 to 50 times, depending on the flow rate. Within the vane chambers, the fluid is accelerated not only in a radial direction but also to the circumferential speed of the rotor. At said circumferential speed and the circulation speed superimposed thereon, the fluid particle passes from the rotor into the side channel. On the subsequent helical trajectory the circulation component is decelerated to only a small extent by wall friction, whereas the circumferential component is markedly decelerated, essentially due only to the pressure buildup. The loss of kinetic energy of the resulting flow is compensated for again and again in the rotor.

Side channel pumps have a lower efficiency than centrifugal pumps, but produce a higher delivery pressure.

Pumps to be used according to the invention are manufactured e.g. by Hermetic-Pumpen GmbH, Germany.

They are able to overcome delivery heights of 15 m and more. An advantage of the invention is that pump cavity and drive compartment are not necessarily arranged above one another, but can, according to the invention, preferably be arranged next to one another. The latter arrangement necessarily means horizontally supported driveshafts, thereby ensuring longer operating times. The design of the drive compartment including the drive can be as shown in FIG. 3 of EP-A 1092874. According to the invention, the pump cavity is preferably made of alloy steel 1.4571 (in accordance with DIN EN 10020). Alternatively, however, it can be made of plastic, concrete, a ceramic material or gray cast iron. The preferred material for the sliding elements (slide ring packings) is SiC.

Instead of using, according to the invention, delivery pumps with a driveshaft it would, in principle, also be possible to use pumps without a driveshaft such as e.g. diaphragm pumps, preferably compressed-air diaphragm pumps. These too likewise satisfy the requirement profile (no contact of the fluid to be delivered with parts subject to high mechanical load such as bearings, no leakages for the fluid F) on which the object of the invention is based. However, their performance is not as high as that of the delivery pumps to be used according to the invention.

In principle, diaphragm pumps operate in the same way as piston pumps, a flexible diaphragm which can be made of plastic or alloy steel taking the place of the piston.

The diaphragm—whose upward and downward motion alternately draws in and expels the fluid via valves—is set in motion by direct coupling with e.g. a drive rod assembly. The diaphragm completely separates the working chamber (pump cavity) from the drive. The sealing problems relevant to the invention therefore do not exist with these pumps. Furthermore, any drive support arrangements are necessarily located outside the working chamber.

Typical operating data of delivery pumps to be used according to the invention are:

Flow rate ($m^3$/h): from 2 to 4000

Delivery height (m): up to 60

Viscosity of the delivery fluid F (mPas): from 0.5 to 50

Rotational speed ($min^{-1}$): from 800 to 3000

Next, it must be pointed out that in the present publication a support is to be understood in quite general terms as a machine element for supporting or guiding machine parts which are movable relative to one another, said support absorbing the arising forces and deflecting them onto the casing, component or foundation.

The method according to the invention is particularly suitable when the (meth)acrylic monomer is (meth)acrylic acid, especially when the (meth)acrylic acid content is ≧95 wt %. But it is also suitable when the fluid to be delivered, instead of (meth)acrylic monomers, contains other unsaturated monomers, for example (meth)acrolein.

EXAMPLES

Example 1

By means of two-stage catalytic gas phase oxidation of propylene with molecular oxygen, a gaseous product gas mixture having the following composition was generated:

9.84 wt % of acrylic acid, 0.4 wt % of acetic acid, 4.4 wt % of water, 0.11 wt % of acrolein, 0.21 wt % of formaldehyde, 0.07 wt % of maleic anhydride, the remainder up to 100 wt % being propionic acid, furfural, propane, propene, nitrogen, oxygen and carbon oxides.

This gaseous product gas mixture was cooled in a spray cooler (direct cooler, quench) by injecting crude acrylic acid (4000 l/h) (the temperature of the crude acrylic acid was 95° C.; the crude acrylic acid used for direct cooling contained initial concentrations of 1.1 wt % of water and 1000 ppm by weight of phenothiazine as a polymerization inhibitor). In so doing, the crude acrylic acid used for quenching was recirculated via a heat exchanger by means of a recirculating pump and each time readjusted to 95° C.

The recirculating pump used was a centrifugal pump according to the invention of the type Hermetic-Pumpe, model HK (from Hermetic-Pumpen GmbH, DE). The barrier liquid used was 2-ethylhexanol. The leakage rate was 14 g of 2-ethylhexanol per day. The barrier liquid was at a pressure of 4 bar. The separator compartment was equipped with double-acting slide ring packings made of SiC (material of the rotating disk). The driveshaft was supported horizontally.

The cooled gas mixture which exited from the spray cooler and contained the acrylic acid to be separated off was introduced below the bottommost tray into a rectifying column which was equipped with 27 bubble-cap trays and, at the column head, with a spray condenser. The temperature at the column head was 20° C. and the bottoms temperature of the rectifying column was 90° C.

The condensate which was produced in the spray condenser and mainly consisted of water was removed and, after the addition of 300 ppm by weight of hydroquinone and cooling in a heat exchanger, was reintroduced as spray liquid having a temperature of 17° C. as reflux via the spray condenser onto the topmost column tray. The reflux ratio was 4.

Some of the crude acrylic acid collected in the rectifying column bottoms was discharged (430 g/h) and some (250 g/h), after the addition of 1000 ppm by weight of phenothiazine in order to inhibit polymerization within the rectifying column, was recycled to the 13th tray of the column (counting from the bottom), and some (about 15 l/h) was first passed via a heat exchanger and then, at 100° C., recycled onto the 2nd tray of the column (counting from the bottom upward) to adjust the column temperature.

To maintain the liquid balance in the quench, a further fraction of the crude acrylic acid collecting in the column bottoms was fed, level-controlledly, to said quench at a temperature of 102° C. via a heat exchanger upstream of the quench.

The discharged crude acrylic acid contained 97.2 wt % of acrylic acid, 1.6 wt % of acetic acid, 0.024 wt % of propionic acid, 0.4 wt % of maleic acid, 0.005 wt % of acrolein, 0.02 wt % of furfural and 1.2 wt % of water, and additionally 500 ppm by weight of phenothiazine and 300 ppm by weight of hydroquinone.

The above-described process was run uninterruptedly for 10 days. At the end of the 10 days, the entire quench circuit including the pump was free from polymeric deposits.

Comparative Example

The same procedure was followed as in example 1, except that the recirculating pump used in the quench was a compressed air diaphragm pump of the type Almatec-Pumpe Series FP-100, the material used being polytetrafluoroethylene (PTFE), from Almatec Maschinenbau GmbH, DE. The pump was made entirely of Teflon. Here, too, the entire quench circuit including the pump after 10 days was still free from polymeric deposits.

Comparative Example 2

The same procedure was followed as in example 1. The recirculating-pump used in the quench was a gear pump of type Hermetic-Pumpe, type ZML hermetic from Hermetic-Pumpen GmbH, DE. In the case of a gear pump, the fluid to be delivered is displaced by mutually rotating and meshing gearwheels and is thus conveyed onward.

The driveshafts of the gear wheels, because of their weight, were likewise supported in the pump cavity. The plain bearings in question were made of graphitic carbon.

Within less than 10 hours' operation, the gear pump was blocked by polymer being formed.

Comparative Example 3

As in comparative example 2, except that the plain bearings were made of SiC. Within less than 10 hours' operation, the gear pump was blocked by polymer being formed.

Comparative Example 4

The same procedure was followed as in example 1. The recirculating pump used in the quench was a centrifugal pump of type CP-Pumpe, pump type MKP 32-160 (CP-Pumpen AG, DE). The pump cavity and the drive compartment are separated by a metal wall. The drive in the pump cavity was via magnetic coupling. The driveshaft was supported in the pump cavity by means of a shaft bearing made of SiC.

Within less than 10 hours' operation, the centrifugal pump was blocked by polymer being formed.

Example 2

The same procedure was followed as in example 1. The recirculating pump used in the quench was a centrifugal pump of type Hermetic Pumpe model HK (Hermetic Pumpen GmbH). The pump was modified in accordance with the invention, using a dry-running, non-contact, gas-lubricated shaft seal and was fitted with double-acting slide ring packings made of SiC.

The barrier gas used was air which was at a pressure of 4 bar. The leakage rate was 100 Nml/h.

After 10 days' operation, the entire quench circuit including the pump was still free from polymeric deposits.

We claim

1. A method of delivering a fluid that contains at least one (meth)acrylic monomer by a delivery pump comprising a) a pump cavity, b) a drive compartment, and c) a separator compartment that separates the pump cavity and the drive compartment, and wherein the pump cavity contains at least one delivery element for delivering the fluid;

the fluid is fed to the pump cavity with an input energy;

the fluid leaves the pump cavity with an output energy that exceeds the input energy;

a driveshaft driven in the drive compartment is run out from the drive compartment through the separator compartment into the pump cavity;

the at least one delivery element contained in the pump cavity is linked to the driveshaft run into the pump cavity such that the driveshaft is configured to transmit a torque to the delivery element;

the separator compartment is filled with a barrier medium comprising at least one of a barrier gas and a barrier liquid that differs from the fluid; and the driveshaft is not supported within the pump cavity, wherein a pressure of the barrier medium exceeds a pressure in the pump cavity and a pressure in the drive compartment, and a section of the driveshaft that runs through the separator compartment is fitted, both toward the pump cavity and toward the drive compartment, with sliding elements permanently and impermeably attached to the driveshaft and that sealingly slide on the separator compartment inner walls through which the driveshaft passes.

2. A method as claimed in claim 1, wherein the delivery pump is a centrifugal pump or a side channel pump.

3. A method as claimed in claim 1, wherein the barrier medium used is a mixture of ethylene glycol and water.

4. A method as claimed in claim 3, wherein the separator compartment loses from 0.2 to 0.5 ml/h of barrier medium.

5. A method as claimed in claim 3, wherein the barrier medium comprises from 30 to 40 wt % of ethylene glycol.

6. A method as claimed in claim 1, wherein the barrier medium used is an oxygen-containing gas.

7. A method as claimed in claim 6, wherein the separator compartment loses from 120 to 150 Nml/h of barrier medium.

8. A method as claimed in claim 6, wherein the barrier medium comprises from 4 to 21 vol % of oxygen.

9. A method as claimed in claim 1, wherein the sliding element comprises SiC.

10. A method as claimed in claim 1, wherein the fluid is a (meth)acrylic acid that contains ≧95 wt % of (meth) acrylic acid.

* * * * *